US006460533B1

(12) United States Patent
Greenland

(10) Patent No.: US 6,460,533 B1
(45) Date of Patent: Oct. 8, 2002

(54) ABOUT VERTICALLY ORIENTATED SAW

(76) Inventor: Darrell Greenland, 934-4th St., #21, Santa Monica, CA (US) 90403

( * ) Notice: Subject to any disclaimer, the term of this patent is extended or adjusted under 35 U.S.C. 154(b) by 0 days.

(21) Appl. No.: 09/934,509

(22) Filed: Aug. 21, 2001

(51) Int. Cl.[7] ..... B28D 1/04

(52) U.S. Cl. ..... 125/13.01; 125/35; 451/361; 451/406; 451/414

(58) Field of Search ..... 451/340, 361, 451/360, 359, 364, 406, 414; 125/35, 12, 13.01, 13.03; 83/471.2, 477

(56) References Cited

U.S. PATENT DOCUMENTS

| | | | | |
|---|---|---|---|---|
| 2,741,277 A | * | 4/1956 | Leger | 83/471.2 |
| 3,122,183 A | | 2/1964 | Striebig | |
| 3,722,497 A | | 3/1973 | Hiestand et al. | |
| 3,763,845 A | | 10/1973 | Hiestand et al. | |
| 4,150,597 A | | 4/1979 | Striebig | 83/471.3 |
| 4,164,883 A | * | 8/1979 | Jagers | 83/488 |
| 4,202,231 A | * | 5/1980 | Striebig | 83/471.2 |
| 4,467,684 A | * | 8/1984 | Thorsell | 83/404.1 |
| 4,476,754 A | * | 10/1984 | Ducret | 83/150 |
| 5,148,732 A | | 9/1992 | Striebig | 83/863 |
| 6,080,041 A | | 6/2000 | Greenland | 451/11 |
| 6,119,676 A | | 9/2000 | Greenland | 125/35 |

FOREIGN PATENT DOCUMENTS

| | | |
|---|---|---|
| WO | WO99/47324 | 9/1999 |

* cited by examiner

*Primary Examiner*—Timothy V. Eley
(74) *Attorney, Agent, or Firm*—Cislo & Thomas LLP

(57) ABSTRACT

An about vertical tile cutting saw having a structure that orientates the ceramic tile for cutting in an about vertical plane and wherein the saw blade cutting means is disposed rearward of the ceramic tile to the cut, thereby allowing for use of the tile saw in close quarters.

14 Claims, 3 Drawing Sheets

ABOUT VERTICALLY ORIENTATED SAW

BACKGROUND OF THE INVENTION

1. Field of the Invention

This invention relates to saws, particularly of the type used for cutting ceramic tile and/or stone, marble, granite, composites, etc. in close quarters as may be encountered in household kitchens, restrooms and the like, wherein fairly large tiles, for example, because of the orientation of the saw, may be easily cut with a minimum of room requirement and a minimum of mess to the surroundings where the cutting of the ceramic tile would normally take place.

2. Description of the Related Art

In the cutting of stone and ceramics, particularly in close quarters as may be encountered in dwellings, as for example restrooms, kitchens and the like, the cutting of large tile, for example, pieces is almost impossible because the sawing device takes up a great deal of room should the tile be placed on the conventional horizontal table for cutting. Additionally, because the horizontally disposed saw requires a cooling liquid such as water, it creates a mess in that the cooling liquid is pumped to impinge upon the saw which then deflects the coolant to the surrounding environs in a splattering effect.

While there are disclosures in the prior art of various saws that are contemplated to be utilized in vertical positions, none of the prior art discloses an about vertically orientated support which can cut stone slabs or tile in an efficient, less cumbersome and less messy fashion.

U.S. Pat. No. 5,148,732 issued to Striebig teaches a saw unit for a vertical board wherein a housing is moveable vertically relative to a workpiece, and wherein the saw blade is mounted for pivotal movement.

U.S. Pat. No. 4,150,597 to Striebig discloses a saw arrangement in which a panel to be cut is placed into an upright position by a frame and is supported by a lower edge rest and includes a vertically extending carrier bar horizontally sweeping the work area, and wherein a sawing device is moveable on the carriage transversely to the working plane.

U.S. Pat. Nos. 3,722,497 and 3,763,845 to Hiestand et al. teaches a saw assembly for cutting walls and other flat concrete surfaces wherein the saw is mounted on a trolley which rides on a track attached to a flat surface by means of mounting brackets.

U.S. Pat. No. 3,122,183 to Striebig teaches a vertically mounted saw for cutting major structural plates having a vertical guide arrangement which is moved horizontally on the upright frame and a motor driven saw cutter is pivotally mounted on a pivot axel perpendicular to the plane of the upright guide frame so that the saw cutter may be turned to vertical and horizontal cutting planes.

However, none of the prior art devices as set forth above provide a saw which supports the article to be cut in an about vertical position, and wherein the saw is moveable along a back side of the article to be cut to not only make cutting of large articles easier because of the vertical displacement of the support for the article, but also because the coolant liquid, which is normally water, is directed downwardly and thus provides for cutting of the article in an efficient, less room-requiring and less messy manner.

SUMMARY OF THE INVENTION

The present invention remedies shortcomings and drawbacks found in prior art, conventionally found tile and stone slab saws having a horizontally disposed table which take up quite a bit of room where one is cutting fairly large size tiles, etc. as for laying on the floor surface or the like. The about vertical cutting saw of the instant invention, because of the vertical orientation of the support platen or frame being about vertically disposed, allows for secure placement of the ceramic tile or stone slab with respect to the structure, and wherein a cutting saw is mounted in the back of the tile such that when moving the cutting blade in a cutting manner, the dust and refuse from the cutting process is not spewn toward the motor and guide rail and thus keeps the same clean. Additionally, where the about vertical saw is utilized with a basin within which is a pump for pumping coolant liquid such as water to the saw blade, the synchronous movement of a support for the fluid hose and the disposition of the fluid because of the force of gravity and the water catch guard mounted in the rear of the saw makes for less messy, more clean cutting operations.

The about vertical saw of the present invention is simple in mechanical terms and is easily maintained and kept clean while allowing use of the device in fairly close quarters considering the size of ceramic tiles to be cut.

OBJECTS OF THE INVENTION

It is an object of the present invention to provide an about vertical tile, stone, granite and marble cutting saw.

It is another important of the invention to provide an about vertical tile cutting saw which comprises an about vertical support structure in order to support the tile to be cut, and wherein a saw blade means is operatively supported rearward of the tile so that cutting refuse does not foul the motor or guide rail of the cutting saw.

Still another important object of the invention is to provide an about vertical cutting saw which has the cutting blade driven by a motor which is disposed rearward of the frontal surface of the tile to be cut so as to keep the motor clean and free of dust and ceramic particles.

It is still another important object of the invention to provide an about vertical tile saw having a support structure which supports a tile to be cut in an about vertical relationship and wherein a saw blade means is operatively associated with the structure and is intended to travel along a track path rearward of the tile to be cut.

It is still another important specific object of the invention to provide an about vertical tile saw having an about vertical support structure including a lower support on which a ceramic tile is to be cut and which supports the same, and wherein a saw blade means is operatively supported from said about vertical support structure only for about vertical movement therealong whereby a ceramic tile is operatively supported for cutting thereof.

It is still another important more specific object of the invention to provide a structure for supporting large tiles in an about vertical position and wherein a saw blade means is operatively supported for travel along the back side of the tile to be cut and is supported for relative movement thereto, and wherein an outrigger arm supports a fluid conduit hose in order to direct cooling fluid to the saw of the saw blade means.

These and other objects and advantages of the present invention will be apparent from a review of the following specification and accompanying drawings.

DESCRIPTION OF THE PREFERRED EMBODIMENT(S)

Figure 1:
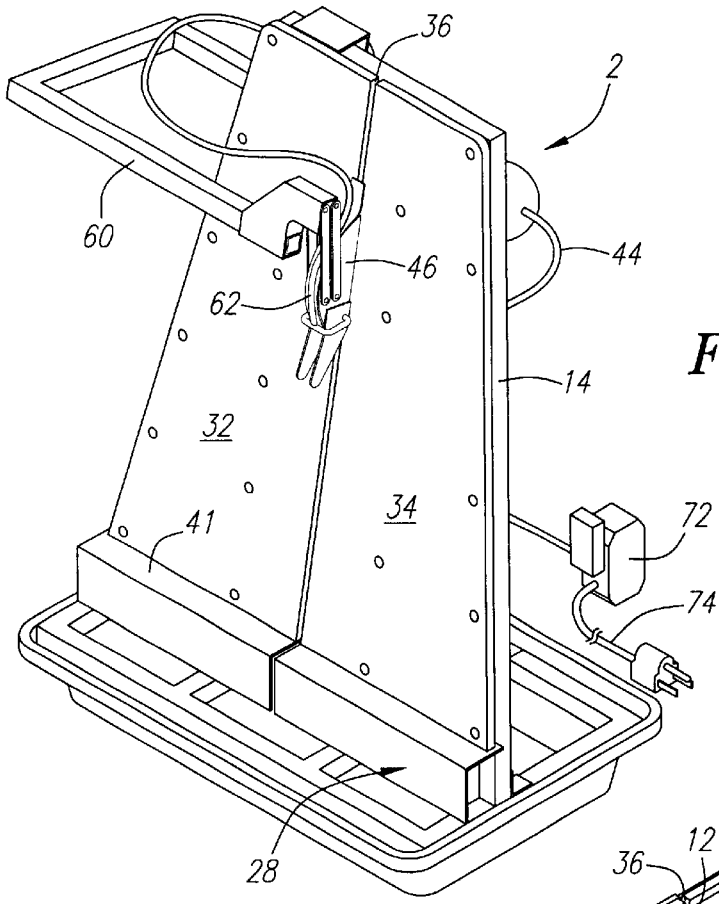
FIG. 1 is a front perspective view of the saw of the invention.
Figure 2:
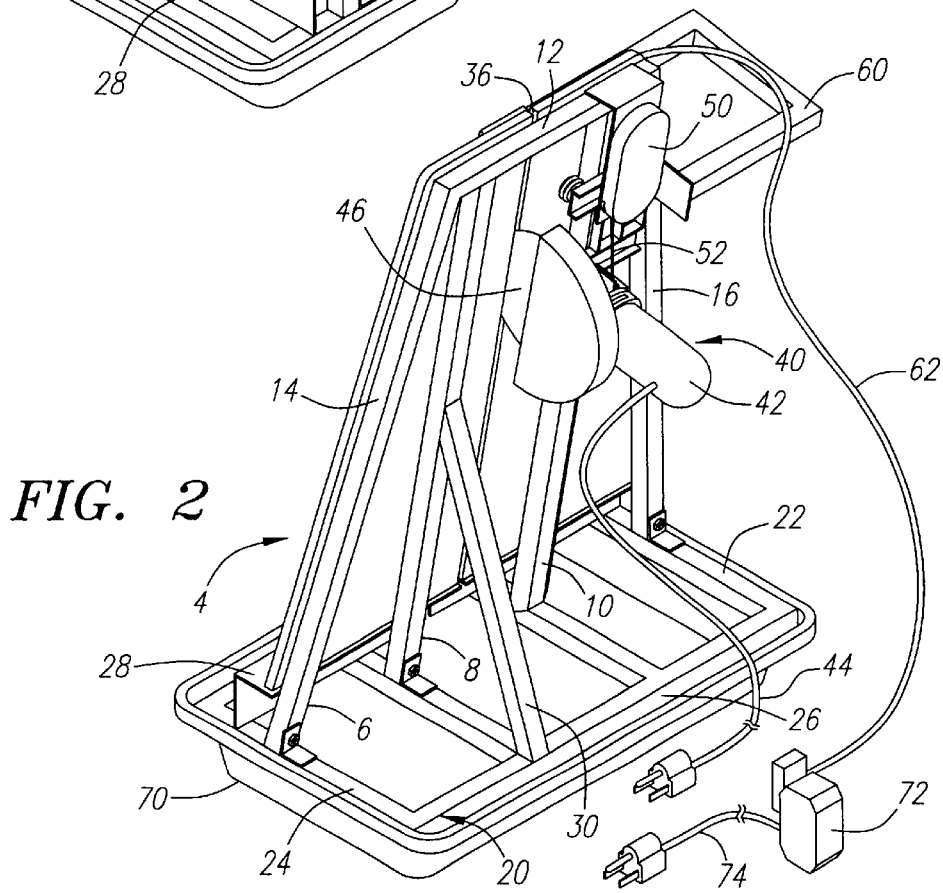
FIG. 2 is a rear perspective view of the saw shown in FIG. 1.
Figure 3:
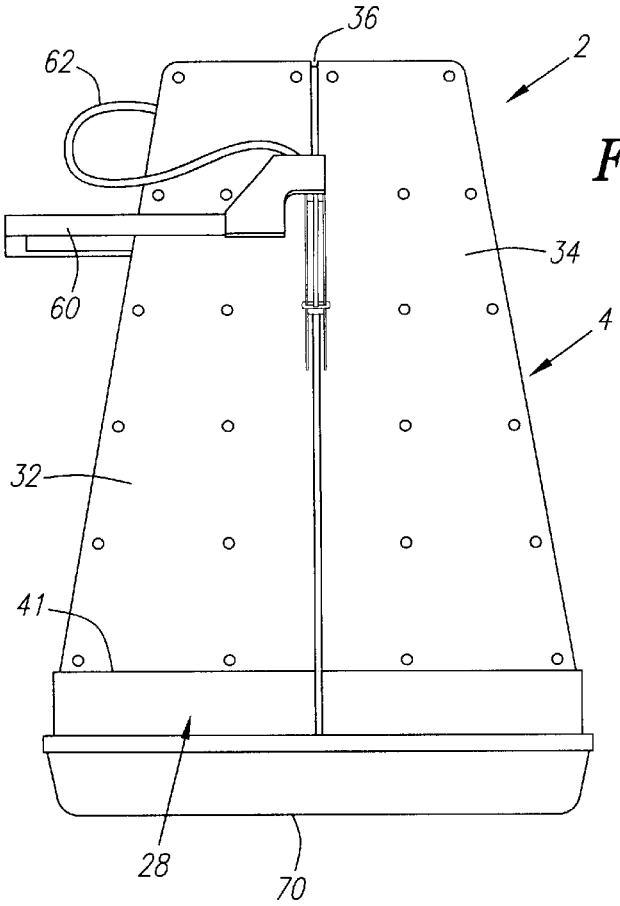
FIG. 3 is a front view of the saw shown in FIG. 1.
Figure 4:
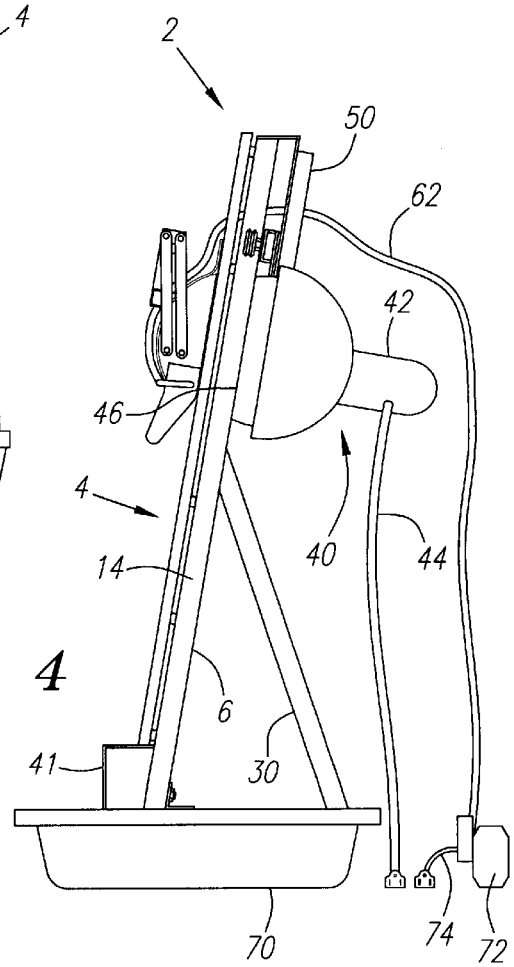
FIG. 4 is a left side elevational view of the cutting saw shown in FIGS. 1, 2 and 3.
Figure 5:
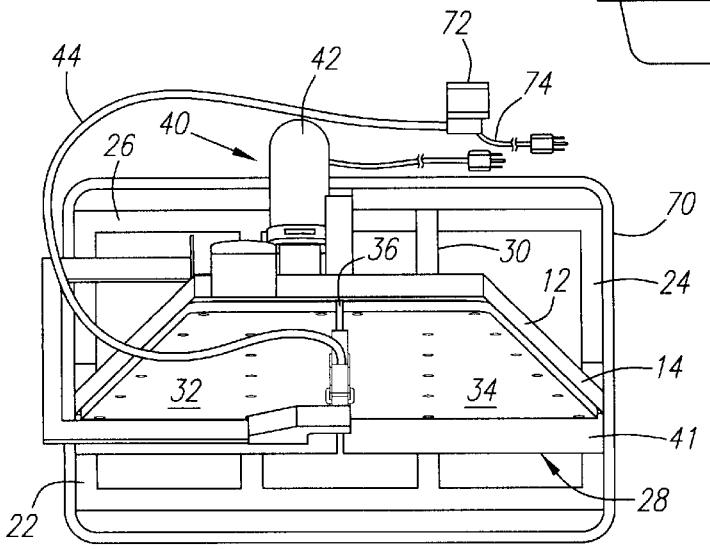
FIG. 5 is a top plan view of the saw of the invention.
Figure 6:
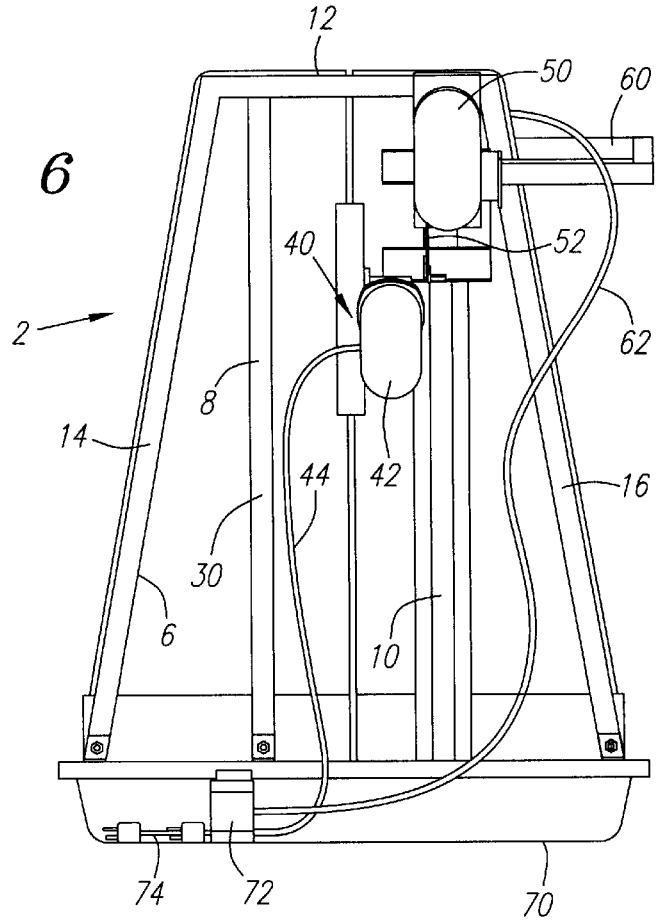
FIGS. 6 and 7 show additional views of the device pictured in FIGS. 1 and 2.
Figure 7:
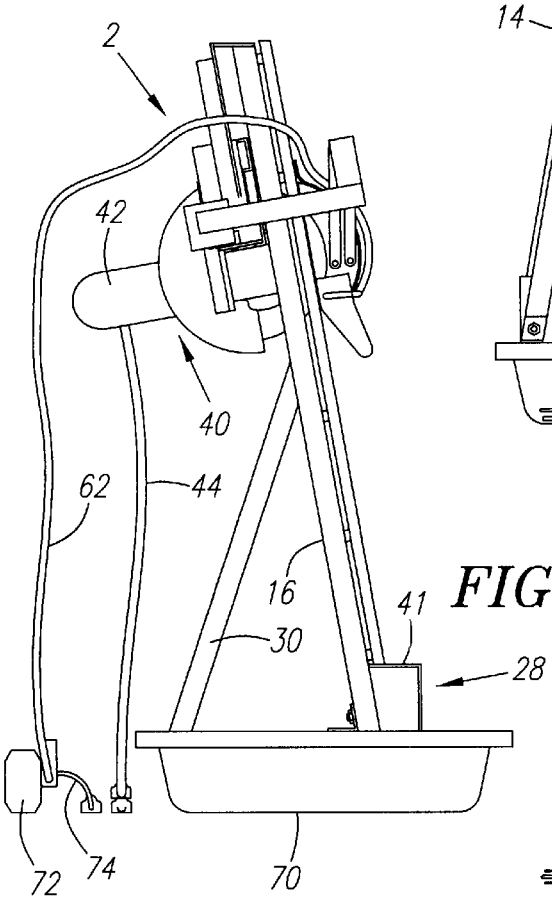
Figure 8:
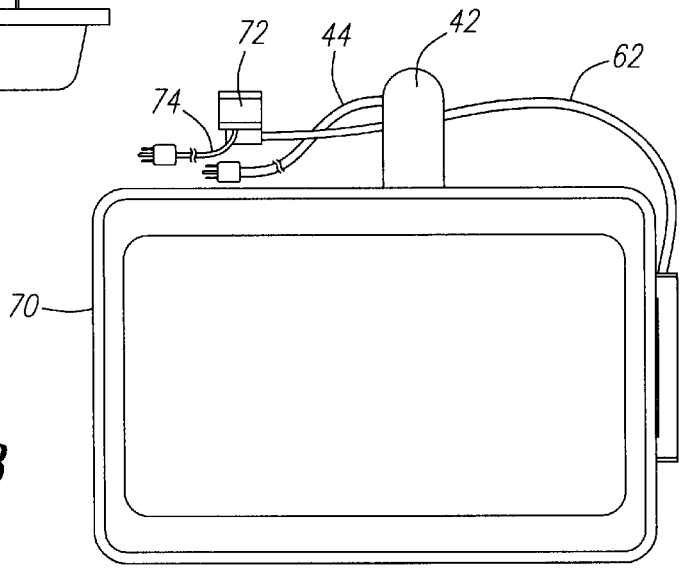
FIG. 8 is a bottom view of the device of the invention.

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Generally, the invention relates to an about vertically oriented structure including a lower support upon which a ceramic tile or other slab like article is to be cut may be supported. A saw blade means is operatively supported from said about vertical support structure and is disposed only for about vertical movement therealong whereby a ceramic tile or other article is operatively supported for the cutting thereof.

Using the device of the present invention, a structure is provided which allows for the cutting of large ceramic tiles using a minimum of space compared to conventional tile saws, and wherein the tile saw because of the vertical orientation and disposition of introduction of cooling fluid at the saw blade provides for less mess and less contamination of the motor and guide rail.

Referring to the drawings wherein like numerals of reference designate like elements throughout, it will be seen that the about vertical tile or the like saw 2 of the invention comprises a support structure 4 here consisting of elongate tubular members 6, 8, 10 welded or otherwise secured to a top member 12 with lateral bars 14, 16 terminating in rectangular bottom frame 20 comprised of short bars 22, 24 and side bars 26 and L-shaped support flange member 28. It will be noted that the elongate bar 8 has slanted support 30 and each of the support structures disclosed may be secured by means of welding or other means well known in the art.

Supported in secure fashion from side bars 14, 16 which are positioned in inwardly converging relationship are two front support plates 32, 34 welded or otherwise secured by other conventional means known in the art so as to form a space 36 therebetween for purposes to be described. Obviously, instead of two separate plates 32 and 34, one single support with appropriate groove or slot may be utilized.

The L-shaped flange-like member 28 forms a ledge support 40 upon which the edge of a ceramic tile or the like (not shown) may be supported. The outward surface of plates 32, 34 also provide support for the ceramic tile (not shown).

Mounted on about vertical elongate member 10 is saw blade means 40 having electric motor 42, electrical cord 44 and having circular saw blade 46. It will be noted that the saw blade means 40 is supported for travel along the track or guide defined by about vertical support 10 and is moveable therealong by reason of retractable spring mechanism 50 secured to top member 12. Saw blade means 40 is secured to travel along the track or guide defined by elongate member 10 such that the spring 52 supporting the saw blade means 40 allows for movement of the saw blade means 40 along the track defined by elongate member 10 from the bottom of device 2 to the top thereof.

Attached to saw blade means 40 which as indicated is moveable along the track defined by elongate member 10 is outrigger arm 60 which travels in synchronous fashion to the saw blade means 40 and is utilized to secure the fluid hose 62 in proximity to the saw blade 46, and wherein the about vertical tile saw 2 is disposed within or above basin 70 within which is cooling fluid such as water (not shown) and wherein the sump or submergible pump 72 is placed and which of course is powered through means of electrical cord 74.

The saw blade means 40 may also be positionable for travel along the path defined by the track of elongate member 10 by means of a counter weight, but the disclosed spring mechanism 50 has been found to be most desirous because of its light weight.

While the present invention has been described with regards to particular embodiments, it is recognized that additional variations of the present invention may be devised without departing from the inventive concept.

EXAMPLE

A tile saw 2 like that shown in the drawings was constructed having the following dimensions:

Base: 16"×26"

Height: 34"

Width of tile support at base: 24"

Width of tile support at top: 14"

Height of tile support from support flange to top: 29"

Groove width of tile support: ¼"

It will be noted that the support surfaces 32, 34 are at an angle of about 5–15 degrees from vertical such that a tile placed thereon is supported by bottom support surface or flange 41 and the surfaces of plates 32, 34.

By the disclosed tile saw of the invention, it is clear that by being about vertically oriented, a fairly large ceramic tile may be cut to size by reason of the about vertical orientation of the piece to the cut, and further because the motor of the saw blade means is disposed rearward of the cutting surface of the ceramic tile, and also because the cooling liquid is aided by the force of gravity, the tile saw 2 of the invention takes up less space in cutting ceramic tiles, is easy to utilize and is less messy than would be encountered in conventional tile saws. Further it should be noted that the outrigger structure 60 permits accommodation of fairly large tiles for ease of cutting. Alternatively the outrigger structure 60 may be vertically mounted.

While the invention has been described with specific particularity to the drawings, it should be understood that various changes and modifications may be made all without departing from the scope of the invention. For example, while certain structures and functions thereof have been disclosed, it should be obvious to those of ordinary skill in the art that various alternatives are available.

For example, while the various components of the invention have been shown as being welded, it is to be noted that other conventional means of securing support structure, as by electrode welding, mechanical fasteners and the like would suffice equally as well. Additionally, while a specific type of support member has been disclosed as a backing for the ceramic tile to be cut in a specific type of abutment support for the lower edge thereof has been shown, it should be clear that various structures and designs will present themselves and all such changes and modifications are intended to be covered by the appended claims.

Additionally, while some of the components have been shown to be made up of several different components, integral members may be used. Also, while the ideal practice of the invention utilizes a sump pump placed in the basin with which the tile saw of the invention is utilized, it should be clear that one need not necessarily use this cooling liquid. Nor would one necessarily have to utilize a basin associated with the tile saw as when cutting articles dry, for example. While the invention has been described as for cutting ceramic tiles, it should be understood that other articles are contemplated such as slab stone, granite, marble, composites, etc.

Thus, while the present invention has been described with regard to specific structural and other embodiments, it is to be recognized that additional variations of the present invention may be devised without departing from the inventive scope.

What is claimed is:

1. An about vertical article cutting saw comprising the combination of:

an about vertical support structure including a stationary lower support upon which an article to be cut may be supported, a freely moveable saw blade means operatively supported from said about vertical support structure only for about vertical movement therealong and wherein said blade means is supported by a retractable support which allows said saw blade means to operatively travel about the height of said about vertical support structure whereby an article is operatively supported for cutting thereof.

2. An about vertical article cutting saw comprising the combination of:

an about vertical support structure including a stationary lower support upon which an article to be cut may be supported, a freely moveable saw blade means operatively supported from said about vertical support structure only for about vertical movement therealong whereby an article is operatively supported for cutting thereof and wherein said about vertical support structure is supportable relative to a fluid basin, and wherein said saw blade means is supported by a retractable support which allows said saw blade means to operatively travel about the height of said about vertical support structure.

3. The saw in accordance with claim 2 wherein said article is a ceramic tile and said saw blade means is supported opposite thereof.

4. The saw in accordance with claim 3 wherein said about vertical support structure comprises a planar back adapted to allow the saw blade of said saw blade means to project outwardly to engage said article to be cut.

5. An about vertical article cutting saw comprising the combination of:

an about vertical support structure including a lower support upon which an article to be cut may be supported, a saw blade means operatively supported from said about vertical support structure only for about vertical movement therealong whereby an article is operatively supported for cutting thereof and wherein said about vertical support structure is supportable relative to a fluid basin; said article is a ceramic tile and said saw blade means is supported opposite thereof; said saw blade means being supportable by a retractable support which allows said saw blade means to operatively travel about the height of said about vertical support structure; said about vertical support structure comprising a planar back adapted to allow the saw blade of said saw blade means to project outwardly to engage said ceramic tile to be cut; and wherein a support arm supports a fluid hose in moveable relationship to said about vertical support structure and moves synchronously with said saw blade when said saw blade means operatively travels about the height of said about vertical support structure.

6. The saw in accordance with claim 5 wherein said fluid hose is positioned at said article to be cut adjacent said saw blade.

7. The saw in accordance with claim 6 wherein said retractable support is a wound spring.

8. The saw in accordance with claim 7 wherein said about vertical support structure comprises an about vertically supported back plate adapted to allow travel of said saw blade therealong, supported by at least one about vertical member defining a track along which said saw blade means is supported for travel therealong; and lower frame members configured to be supported in association with a fluid basin in which is contained a fluid pump for pumping fluid from said basin to said saw blade.

9. An about vertical cutting saw for cutting ceramic tiles comprising the combination of:

an about vertical support member having at least one about vertically orientated, elongated member defining a track, a backing support formed by adjacently positioned plates having a single space therebetween; a rectangularly configured base operatively associated with said about vertically orientated elongated member and adapted to be received within a fluid basin, a horizontally orientated support for cooperatively receiving a ceramic tile to be cut thereon, said ceramic tile having a bottom edge resting thereon and a back surface supported by said backing support; and an electrically powered motor and saw blade operatively positioned on said elongated member only for movement therealong and only for travel coextensive with said single space, whereby a supported tile may be cut.

10. The saw in accordance with claim 9 which additionally includes a fluid basin congruently configured to said base and wherein an outrigged arm is adapted for synchronous movement with said electrically powered motor and saw blade.

11. The saw in accordance with claim 10 wherein said fluid basin contains a fluid pump having an extending hose which terminates on said outrigged arm for delivery of fluid from said basin to said saw blade.

12. The saw in accordance with claim 11 wherein said about vertical support member is inclined a sufficient amount to permit satisfactorily secure support for said ceramic tile operatively positioned therewith.

13. The saw in accordance with claim 12 wherein said about vertical support member is inclined from vertical about 5°–30°.

14. An about vertical cutting saw for cutting ceramic tiles comprising the combination of:

an about vertical support member having at least one about vertically orientated elongated member defining a track, a backing support formed by adjacently positioned plates having a space therebetween; a rectangularly configured base operatively associated with said about vertically orientated elongated member and adapted to be received within a fluid basin, a horizontally orientated support for cooperatively receiving a ceramic tile to be cut thereon, said ceramic tile having a bottom edge resting thereon and a back surface supported by said backing support; and an electrically powered motor and saw blade operatively positioned on said elongated member only for movement therealong and only for travel coextensive with said space, whereby a supported tile may be cut.

* * * * *